US011813542B2

(12) United States Patent
Herbert

(10) Patent No.: US 11,813,542 B2
(45) Date of Patent: Nov. 14, 2023

(54) RIDE VEHICLE TRACKING SYSTEM

(71) Applicant: UNIVERSAL CITY STUDIOS LLC, Universal City, CA (US)

(72) Inventor: Christopher Michael Herbert, Kissimmee, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 312 days.

(21) Appl. No.: 17/306,635

(22) Filed: May 3, 2021

(65) Prior Publication Data

US 2021/0346813 A1 Nov. 11, 2021

Related U.S. Application Data

(60) Provisional application No. 63/022,216, filed on May 8, 2020.

(51) Int. Cl.

| | |
|---|---|
| ***A63G 4/00*** | (2006.01) |
| ***A63G 1/00*** | (2006.01) |
| ***E01B 25/26*** | (2006.01) |

(52) U.S. Cl.

CPC ..... *A63G 4/00* (2013.01); *A63G 1/00* (2013.01); *E01B 25/26* (2013.01)

(58) Field of Classification Search

CPC ..... A63G 7/00; A63G 31/00; A63G 31/02; A63G 1/00; A63G 4/00; B61L 15/00; B61L 25/04

USPC ..... 472/43, 128, 129

See application file for complete search history.

(56) References Cited

U.S. PATENT DOCUMENTS

| | | | | |
|---|---|---|---|---|
| 3,518,422 | A | 6/1970 | Doorley et al. | |
| 5,141,183 | A * | 8/1992 | Jurkowski | B61L 3/22 246/167 M |
| 5,583,844 | A | 12/1996 | Wolf et al. | |
| 10,449,462 | B2 | 10/2019 | Woodcock | |
| 2010/0160054 | A1 | 6/2010 | Henry | |
| 2012/0097508 | A1 | 4/2012 | Son et al. | |
| 2013/0325323 | A1 | 12/2013 | Breed | |
| 2017/0072316 | A1 | 3/2017 | Finfter | |
| 2017/0282715 | A1 | 10/2017 | Fung et al. | |
| 2018/0120862 | A1 * | 5/2018 | Dembinski | G05D 1/0293 |
| 2018/0275680 | A1 | 9/2018 | Gupta et al. | |

(Continued)

OTHER PUBLICATIONS

International Search Report and Written Opinion, PCT/US2021/030942, dated Aug. 3, 2021, 13 pgs.

(Continued)

*Primary Examiner* — Kien T Nguyen

(74) *Attorney, Agent, or Firm* — LOZA & LOZA, LLP; Lew Edward V. Macapagal

(57) ABSTRACT

Aspects of the disclosure relate to a tracking system for a ride vehicle. A tracking system for a ride vehicle includes a contact switch sensor including a plurality of contact closure switches. The contact switch sensor is situated on the ride vehicle. The tracking system for the ride vehicle further includes a plurality of location indicator devices situated on or proximate to a path of the ride vehicle. Each location indicator device of the plurality of location indicator devices is configured to communicate location information to the contact switch sensor via the plurality of contact closure switches when the ride vehicle passes by each location indicator device of the plurality of location indicator devices.

17 Claims, 10 Drawing Sheets

(56) References Cited

U.S. PATENT DOCUMENTS

| | | | | |
|---|---|---|---|---|
| 2018/0339233 | A1 | 11/2018 | Vance et al. | |
| 2019/0050237 | A9 | 2/2019 | Maycock et al. | |
| 2020/0101991 | A1* | 4/2020 | Tatsumi ..... | B60L 3/12 |

OTHER PUBLICATIONS

Loar, Josh The Sound System Design Primer 2019. pp. 218, 219, 223, 224 Routledge New York, NY.

* cited by examiner

RIDE VEHICLE TRACKING SYSTEM

CROSS REFERENCE TO RELATED APPLICATION

This application claims priority to and the benefit of U.S. Provisional application Ser. No. 63/022,216, entitled "RIDE VEHICLE TRACKING SYSTEM" and filed on May 8, 2020, the entire content of which is incorporated herein by reference as if fully set forth below in its entirety and for all applicable purposes.

TECHNICAL FIELD

The technology discussed below relates generally to a ride system, and more specifically to a ride vehicle tracking system.

INTRODUCTION

Major theme park attractions, such as ride systems, typically track a ride vehicle through the use of cameras, wireless networks, infrared (IR) track sensors, and/or rotary encoding techniques. These may be costly options and may significantly increase the operational complexity of the ride systems. Furthermore, ride vehicles may track progress and/or location in a ride system by maintaining a timer. In some scenarios, a ride vehicle may rely on the timer for synchronizing certain functions of the ride vehicle, such as displaying audiovisual effects. However, these functions may lack proper synchronization if the ride vehicle experiences any delays, which may negatively impact a user experience.

BRIEF SUMMARY OF SOME EXAMPLES

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Aspects of the present disclosure are related to a tracking system for a ride vehicle. The tracking system includes a contact switch sensor including a plurality of contact closure switches, the contact switch sensor being situated on the ride vehicle. The tracking system further includes a plurality of location indicator devices situated on or proximate to a path of the ride vehicle. Each location indicator device of the plurality of location indicator devices is configured to communicate location information to the contact switch sensor via the plurality of contact closure switches when the ride vehicle passes by each location indicator device of the plurality of location indicator devices.

In one example, a ride vehicle is disclosed. The ride vehicle includes a contact switch sensor including a plurality of contact closure switches. The contact switch sensor is configured to receive location information from a plurality of location indicator devices via the plurality of contact closure switches. The ride vehicle further includes a processing circuit configured to determine a location of the ride vehicle on a path based on the location information.

In one example, a method for tracking a ride vehicle is disclosed. The method includes receiving location information at a contact switch sensor from at least one location indicator device of a plurality of location indicator devices situated on or proximate to a path of the ride vehicle. The contact switch sensor includes a plurality of contact closure switches configured to receive the location information when the ride vehicle passes by the at least one location indicator device of the plurality of location indicator devices. The method further includes determining a location of the ride vehicle on the path based on the location information.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts. While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, and/or packaging arrangements.

Figure 1:
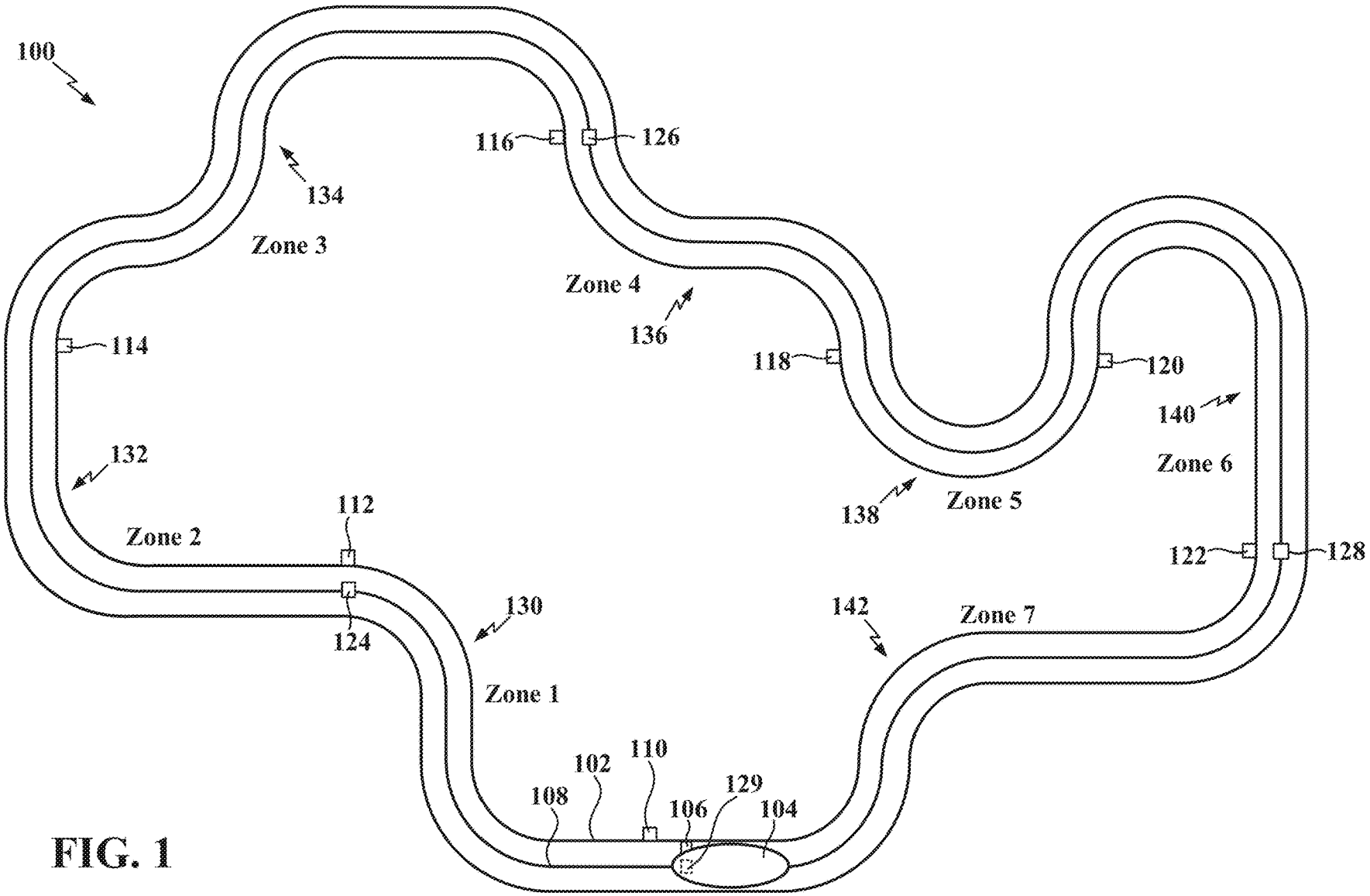
FIG. 1 illustrates a top view of an example ride system in accordance with various aspects of the disclosure.

Aspects of the present disclosure are related to ride vehicle tracking systems. FIG. 1 is a top view of a ride system 100 in accordance with various aspects of the disclosure. As shown in FIG. 1, the ride system 100 may include a path 102 and at least one ride vehicle 104 configured to move along the path 102. In some aspects of the disclosure, the path 102 may include one or more tracks or guide rails, such as the center guide rail 108 shown in FIG. 1, for guiding and/or moving the ride vehicle 104 along the path 102.

As described in detail herein, the ride system 100 may include a number of location indicator devices configured to communicate (e.g., to the ride vehicle 104) a current location of the ride vehicle 104 as it moves along the path 102. For example, as shown in FIG. 1, the ride system 100 may include a first location indicator device 110, a second location indicator device 112, a third location indicator device 114, a fourth location indicator device 116, a fifth location indicator device 118, a sixth location indicator device 120, and a seventh location indicator device 122. The location indicator devices 110, 112, 114, 116, 118, 120 and 122 may be situated on or proximate to the path 102. The number of location indicator devices included in FIG. 1 represents one illustrative implementation and, therefore, it should be understood that a lesser or greater number of location indicator devices than is shown in FIG. 1 may be used in other implementations.

In some aspects of the disclosure, each location indicator device may correspond to a different portion (also referred to as a different zone) of the path 102. For example, the first location indicator device 110 may correspond to a first portion 130 (e.g., also referred to as zone 1) of the path 102, where the first portion 130 begins at the location indicator device 110 and ends at the location indicator device 112. As another example, the second location indicator device 112 may correspond to a second portion 132 (e.g., also referred to as zone 2) of the path 102, where the second portion 132 begins at the location indicator device 112 and ends at the location indicator device 114. Therefore, the location indicator devices 110, 112, 114, 116, 118, 120, 122 may respectively correspond to portions 130, 132, 134, 136, 138, 140, 142, of the path 102.

In some aspects of the disclosure, the ride vehicle 104 may include one or more contact switch sensors configured to receive location information from the location indicator devices of the ride system 100. For example, and as shown in FIG. 1, the ride vehicle 104 may include a contact switch sensor 106 configured to receive location information from the location indicator devices 110, 112, 114, 116, 118, 120, 122. The communication of location information from a location indicator device to the contact switch sensor 106 is described in detail with reference to FIGS. 2-6.

Figure 2:
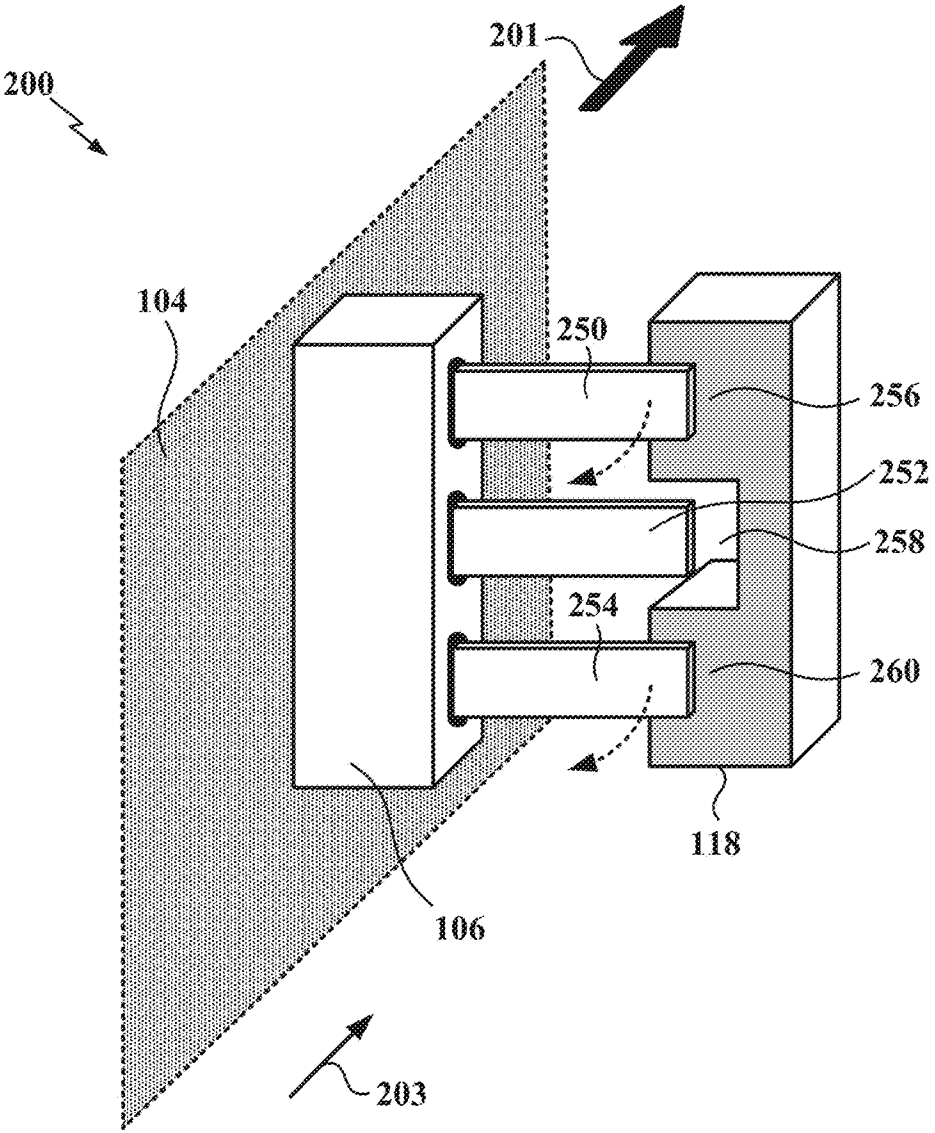
FIG. 2 illustrates a perspective view of one example implementation of a tracking system in accordance with various aspects of the disclosure.

FIG. 2 illustrates a perspective view of one example implementation of a tracking system 200 in accordance with various aspects of the disclosure. In the aspect shown in FIG. 2, the tracking system 200 includes the contact switch sensor 106 and a location indicator device (e.g., the fifth location indicator device 118). The contact switch sensor 106 may be coupled to an outside surface of the ride vehicle 104 (e.g., the shaded region within the dotted lines in FIG. 2). As shown in FIG. 2, the contact switch senor 106 may include a set of switch levers 250, 252, 254, where each switch lever 250, 252, 254 may open or close a corresponding contact switch housed inside the contact switch senor 106. As used herein, the term contact switch may refer to any type of switch that includes at least two contacts configured to physically touch to achieve a closed state (e.g., an ON state) and remain apart to achieve an open state (e.g., an OFF state). Therefore, the term "contact switch" may be used interchangeably with the term "contact closure switch," and the term "contact switch sensor" may be used interchangeably with the term "contact closure switch sensor."

In some aspects of the disclosure, each contact switch housed inside the contact switch sensor 106 may output a first binary value (e.g., a logic '1') when closed or a second binary value (e.g., a logic '0') when open. In some examples, each switch lever 250, 252, 254 may be actuated to close its corresponding contact switch in the contact switch sensor 106 by applying an appropriate amount of force to the switch lever 250, 252, 254. The switch lever 250, 252, 254 may automatically return to its initial position (e.g., with a spring) and open its corresponding contact switch in the contact switch sensor 106 when the force is no longer applied to the switch lever 250, 252, 254.

In some aspects of the disclosure, the binary outputs (e.g., logic '1' or logic '0') from the contact switches in the contact switch sensor 106 may be grouped together to produce an n-bit binary word. In the example implementation of FIG. 2, since the contact switch sensor 106 includes three contact switches, the contact switch sensor 106 may output a 3-bit binary word. For example, a binary output from the contact switch corresponding to the switch lever 250 may be the most significant bit of the 3-bit binary word, a binary output from the contact switch corresponding to the switch lever 252 may be the middle bit of the 3-bit binary word, and a binary output from the contact switch corresponding to the switch lever from the switch lever 254 may be the least significant bit of the 3-bit binary word. For example, if none of the switch levers 250, 252, 254 are actuated, the contact switch sensor 106 may output a 3-bit binary word '000'. As another example, if the switch levers 250 and 254 are actuated (e.g., moved in the direction of the dashed arrows in FIG. 2) and the switch lever 252 is not actuated, the contact switch sensor 106 may output a 3-bit binary word '101'. Therefore, in the example implementation of FIG. 2, the contact switch sensor 106 may output one of eight unique 3-bit binary words (e.g., '000', '001', '010', '011', '100', '101', '110', '111') ata given time based on a state (e.g., actuated/not actuated) of the switch levers 250, 252, 254. In some example implementations, the contact switch sensor 106 may provide the 3-bit binary word to a processing circuit (e.g., the processing circuit 762 described in reference to FIG. 7) through a set of wires (not shown for ease of illustration).

In some aspects of the disclosure, as the contact switch sensor 106 passes by a location indicator device, the location indicator device (e.g., the fifth location indicator device 118 shown in FIG. 2) may communicate location information to the contact switch sensor 106 by applying a unique combination of actuations and non-actuations to the switch levers of the contact switch sensor 106. The contact switch sensor 106 may produce (e.g., output) a unique n-bit binary word (e.g., a 3-bit binary word in the implementation of FIG. 2) based on the combination of actuations and non-actuations. For example, the unique n-bit binary word may correspond to one of the zones on the path 102.

In some implementations, each location indicator device may include a unique combination of actuation regions and cavity regions configured to communicate the previously described n-bit binary word to the contact switch sensor 106. For example, with reference to FIG. 2, the fifth location indicator device 118 may include actuation regions 256, 260 and cavity region 258. It should be noted that the actuation region 256 is approximately aligned with the switch lever 250, the cavity region 258 is approximately aligned with the switch lever 252, and the actuation region 260 is approximately aligned with the switch lever 254. As shown in FIG.

2, as the ride vehicle 104 travels past the stationary fifth location indicator device 118 (e.g., in the direction 201), the actuation regions 256, 260 may contact and actuate the switch levers 250, 254 (e.g., in the direction of the dashed arrows in FIG. 2) while the cavity region 258 may not contact the switch lever 252 resulting in a non-actuation of the switch lever 252. As previously described, this combination of actuations and non-actuations may enable the contact switch sensor 106 to output the 3-bit binary word '101'.

In some aspects of the disclosure, the ride vehicle 104 may store a table that includes a list of the unique n-bit binary words that may be received from the location indicator devices 110, 112, 114, 116, 118, 120 in the ride system 100. The table may indicate a zone (e.g., zone 1, zone 2, . . . , or zone 7) on the path 102 corresponding to each unique n-bit binary word. Accordingly, upon receiving an n-bit binary word from a location indicator device, the ride vehicle 104 may identify the received n-bit binary word in the table and may immediately determine which zone it has entered on the path 102. The table may further indicate a ride vehicle configuration corresponding to each unique n-bit binary word. In some aspects of the disclosure, the ride vehicle configuration may customize the operation of the ride vehicle 104 for each zone (e.g., zone 1, zone 2, . . . , or zone 7) on the path 102. An example of the previously described table is shown in Table 1 below.

TABLE 1

| n-bit binary word | Zone | Ride Vehicle Configuration |
|---|---|---|
| 001 | 1 | A |
| 010 | 2 | B |
| 011 | 3 | C |
| 100 | 4 | D |
| 101 | 5 | E |
| 110 | 6 | F |
| 111 | 7 | G |

Figure 3:
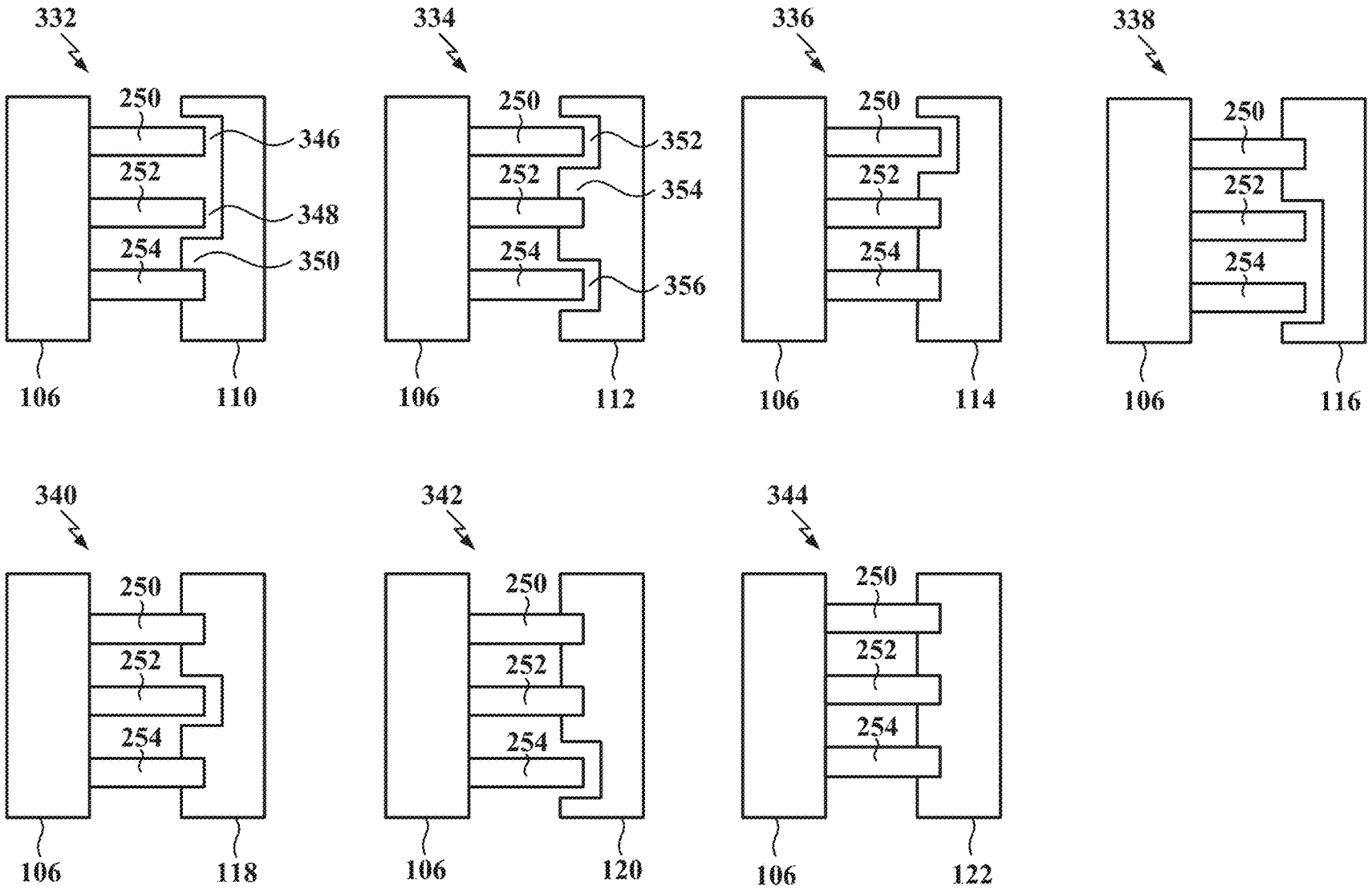
FIG. 3 illustrates side views of a contact switch sensor and location indicator devices in accordance with various aspects of the disclosure.

FIG. 3 illustrates side views of the contact switch sensor 106 and the location indicator devices 110, 112, 114, 116, 118, 120, 122 in accordance with various aspects of the disclosure. The contact switch sensor 106 and the location indicator devices 110, 112, 114, 116, 118, 120, 122 shown in FIG. 3 may collectively be referred to as a tracking system. The side views of the contact switch sensor 106 and the location indicator devices shown in FIG. 3 may be similar to the view of the contact switch sensor 106 shown in FIG. 2 looking in the direction of arrow 203. As shown in configurations 332, 334, 336, 338, 340, 342, and 344 of FIG. 3, the contact switch sensor 106 may receive unique location information from the location indicator devices 110, 112, 114, 116, 118, 120, 122 via the switch levers 250, 252, 254. For example, the location indicator devices 110, 112, 114, 116, 118, 120, 122 in FIG. 3 may be configured to communicate the corresponding 3-bit binary words '001', '010', '011', '100', '101', '110', '111' to the contact switch sensor 106. With reference to the location indicator device 110 in configuration 332, for example, the cavity regions 346, 348 and the actuation region 350 of the location indicator device 110 may communicate the 3-bit binary word '001' to the contact switch sensor 106 as the contact switch sensor 106 passes by the location indicator device 110. As another example, with reference to the location indicator device 112 in configuration 334, the cavity regions 352, 356 and the actuation region 354 of the location indicator device 112 may communicate the 3-bit binary word '010' to the contact switch sensor 106 as the contact switch sensor 106 passes by the location indicator device 112. In the example implementation of FIG. 3, the 3-bit binary words '001', '010', '011', '100', '101', '110', '111' may respectively correspond to zones 1 through 7 of the path 102 in FIG. 1.

Figure 4:
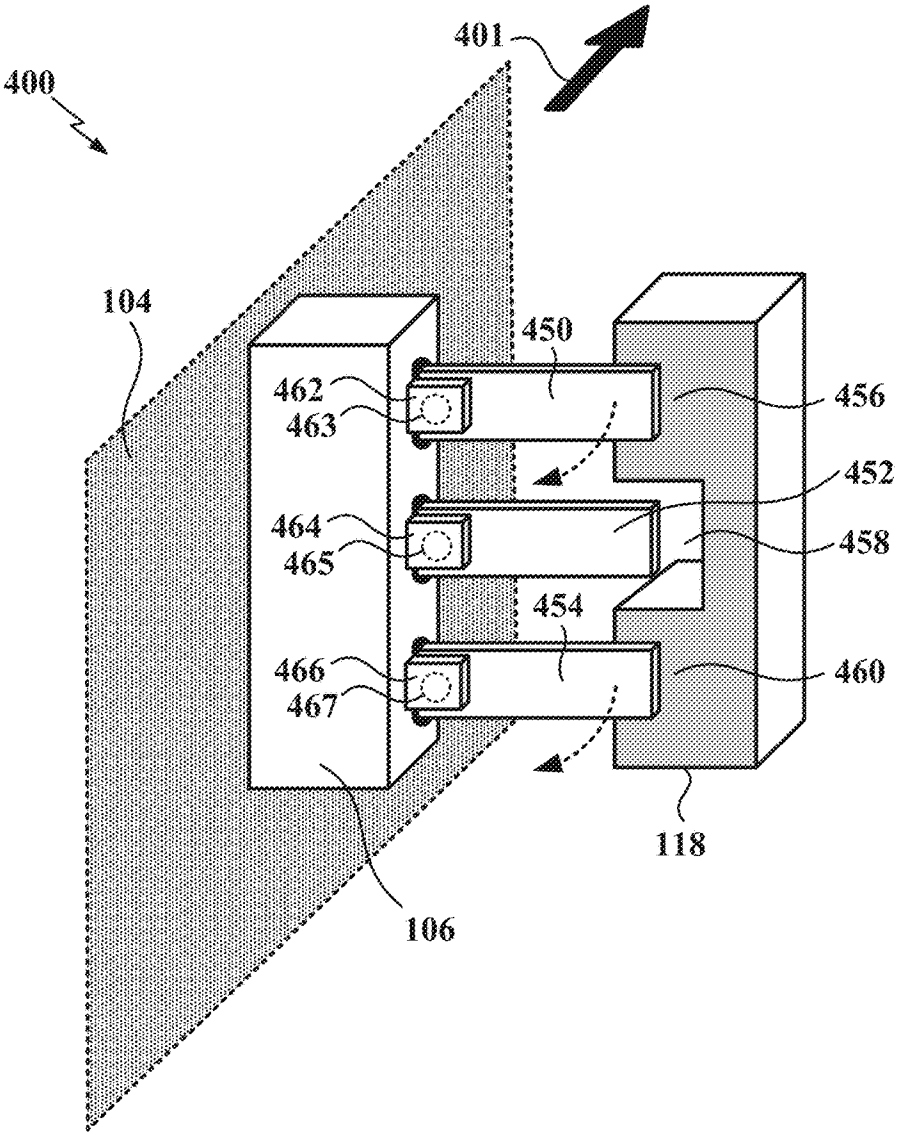
FIG. 4 illustrates a perspective view of an example implementation of a tracking system in accordance with various aspects of the disclosure.

FIG. 4 illustrates a perspective view of another example implementation of a tracking system 400 in accordance with various aspects of the disclosure. In the aspect shown in FIG. 4, the tracking system 400 includes the contact switch sensor 106 and a location indicator device (e.g., the fifth location indicator device 118). As shown in FIG. 4, the contact switch sensor 106 may include a set of contact switches 462, 464, 466, where each of the contact switches 462, 464, 466 may be closed or opened by actuating its push-button 463, 465, 467 with a corresponding switch lever 450, 452, 454. In some aspects of the disclosure, each of the contact switches 462, 464, 466 may output a first binary value (e.g., a logic '1') when closed or a second binary value (e.g., a logic '0') when open. In some examples, each of the switch levers 450, 452, 454 may be actuated to close its corresponding contact switch 462, 464, 466 by applying an appropriate amount of force to the switch lever 450, 452, 454. For example, the appropriate amount of force applied to the switch lever 450 may be an amount of force needed to actuate (e.g., depress) the corresponding push-button 463 to effectively close the contact switch 462. The switch lever 450 may automatically return to its initial position and open its corresponding contact switch 462 when the force is no longer applied to the switch lever 450.

Figure 5:
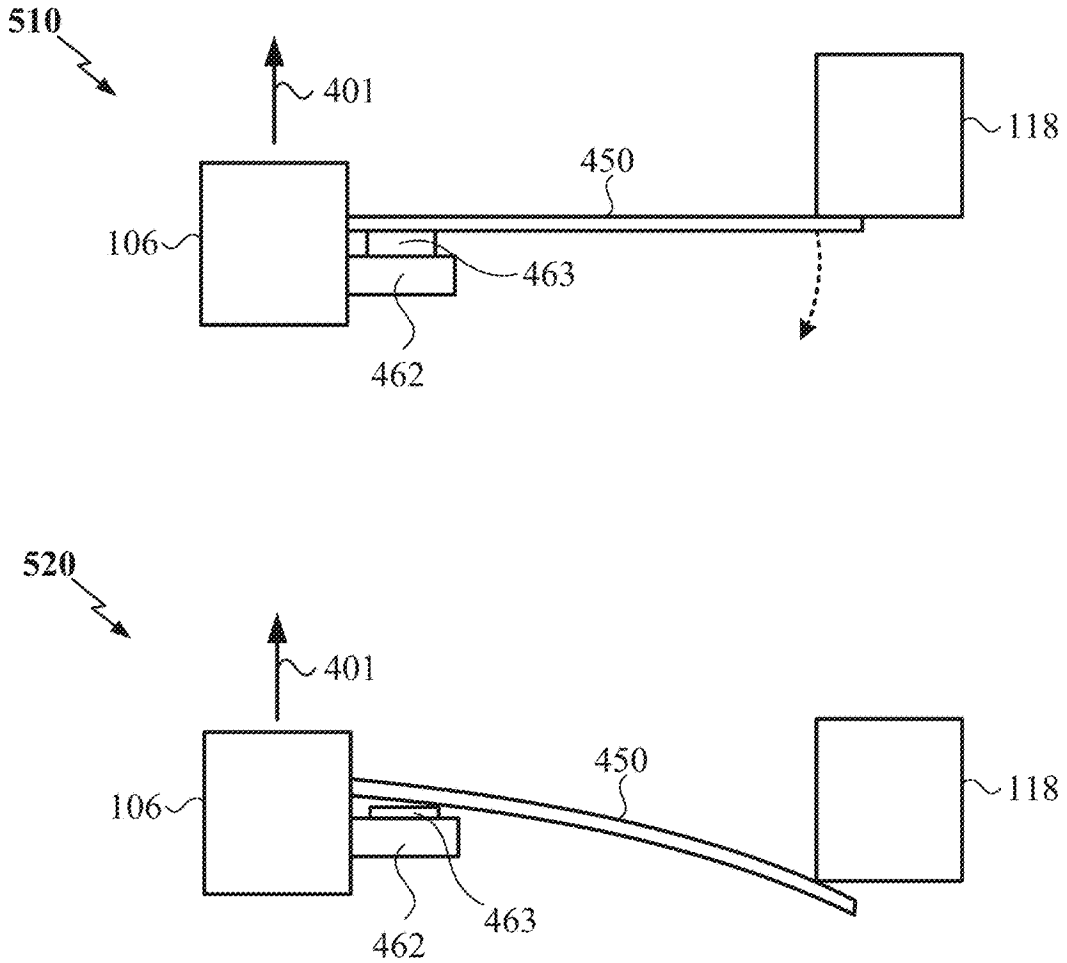
FIG. 5 shows top views of the contact switch sensor shown in FIG. 4 during an actuation of a switch lever.

FIG. 5 shows top views of the contact switch sensor 106 shown in FIG. 4 during an actuation of the switch lever 450. In configuration 510, the contact switch sensor 106 may be moving in the direction 401 while the fifth location indicator device 118 remains stationary as previously described with reference to FIG. 4. It should be noted that the push-button 463 of the contact switch 462 in configuration 510 is not yet actuated (e.g., depressed) and, therefore, the contact switch 462 remains open. In configuration 520, as the contact switch sensor 106 continues to move in the direction 401, the switch lever 450 makes contact with the fifth location indicator device 118 and moves toward the contact switch 462. As shown in configuration 520, the switch lever 450 actuates the push-button 463 and closes the contact switch 462. In some aspects of the disclosure, the push-button 463 and/or the switch lever 450 may be configured with one or more springs (or other suitable mechanism) to return back to their original position (e.g., the configuration 510) after the contact switch sensor 106 has completely passed by the fifth location indicator device 118. In these aspects, the push-button 463 and the switch lever 450 may be ready to receive location information from a subsequent location indicator device (the sixth location indicator device 120).

In some aspects of the disclosure, the binary outputs (e.g., logic '1' or logic '0') from the contact switches 462, 464, 466 in the contact switch sensor 106 may be grouped together to produce a 3-bit binary word similar to the implementations previously explained with reference to FIGS. 2 and 3. For example, a binary output from the contact switch 462 may be the most significant bit of the 3-bit binary word, a binary output from the contact switch 464 may be the middle bit of the 3-bit binary word, and a binary output from the contact switch 464 may be the least significant bit of the 3-bit binary word. For example, with reference to FIG. 4, if none of the switch levers 450, 452, 454 are actuated, the contact switch sensor 106 may output a 3-bit binary word '000'. As another example, if the switch levers 450 and 454 are actuated (e.g., moved in the direction of the dashed arrows in FIG. 4 due to contact with the respective actuation regions 456, 460) and the switch lever 452 is not actuated (e.g., due to the cavity region 458), the contact switch sensor 106 may output a 3-bit binary word '101'. Therefore, in the example implementation of FIG. 4, the contact switch sensor 106 may output one of eight unique 3-bit binary words (e.g., '000', '001', '010', '011', '100', '101', '110', '111') ata given time based on a state (e.g., actuated/not actuated) of the switch levers 450, 452, 454.

Figure 6:
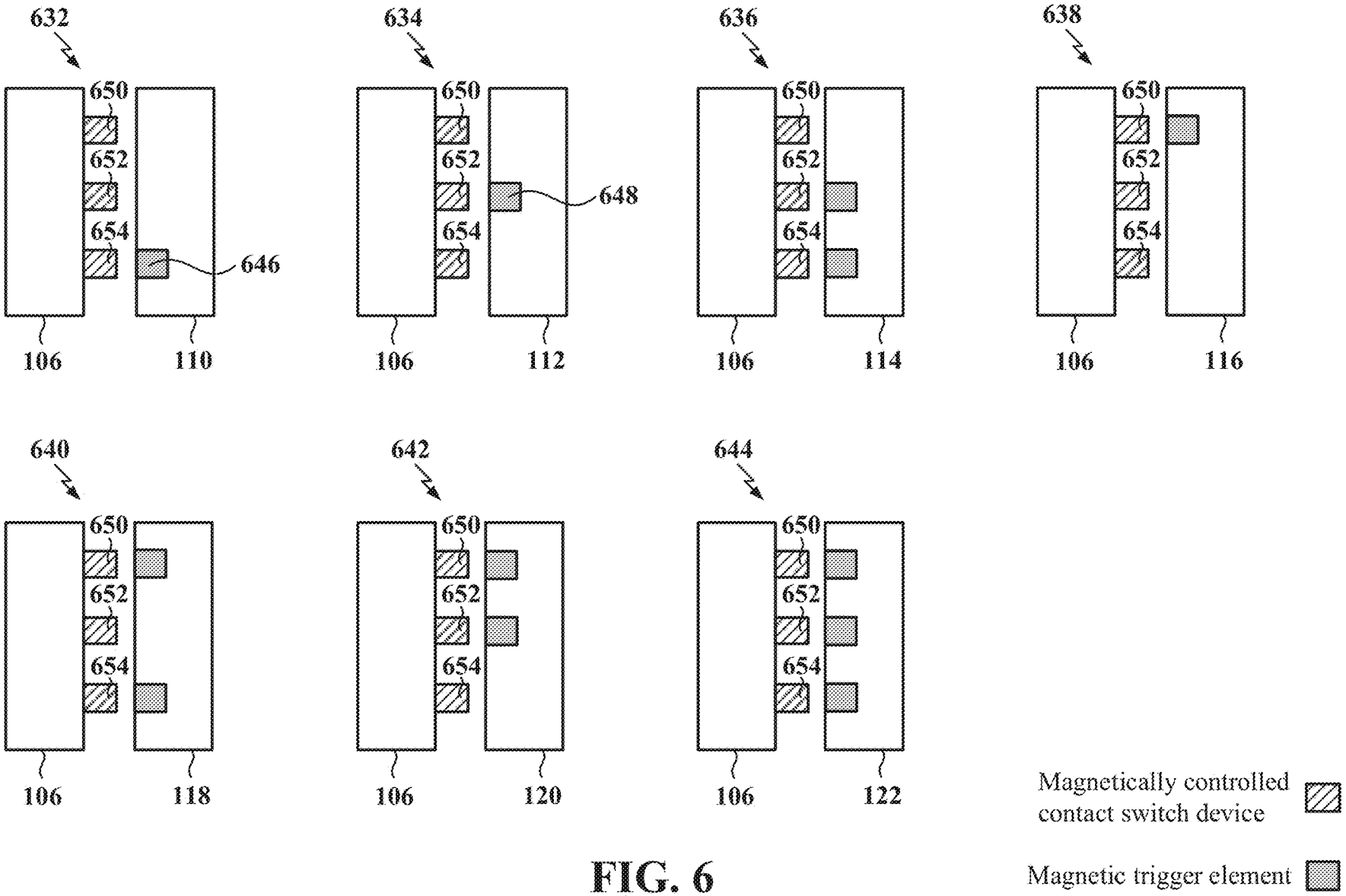
FIG. 6 illustrates side views of a contact switch sensor and location indicator devices in accordance with various aspects of the disclosure.

In some aspects of the disclosure, and as described in detail with reference to FIG. 6, the contact switch sensor 106 may be configured to receive location information from the location indicator devices in FIG. 1 without any physical contact with the location indicator devices. FIG. 6 illustrates side views of the contact switch sensor 106 and the location indicator devices 110, 112, 114, 116, 118, 120, and 122 in accordance with various aspects of the disclosure. The contact switch sensor 106 and the location indicator devices 110, 112, 114, 116, 118, 120, 122 shown in FIG. 6 may collectively be referred to as a tracking system. For example, the contact switch sensor 106 may include magnetically controlled contact switches (e.g., magnetically controlled contact switches 650, 652, 654) that may be controlled (e.g., opened or closed) via magnetic trigger elements. In some aspects of the disclosure, the magnetically controlled contact switches (also referred to as magnetically controlled contact switch devices) described herein may be reed switches or other suitable types of magnetically controlled switches. Therefore, in some aspects of the disclosure, each of the location indicator devices 110, 112, 114, 116, 118, 120, 122 (e.g., as shown in respective configurations 632, 634, 636, 638, 640, 642, 644 in FIG. 6) may communicate location information to the contact switch sensor 106 by applying a unique combination of magnetic triggers and non-triggers to the magnetically controlled contact switches of the contact switch sensor 106. The contact switch sensor 106 may produce (e.g., output) a unique n-bit binary word (e.g., a 3-bit binary word in the implementation of FIG. 6) based on the combination of magnetic triggers and non-triggers. For example, the unique n-bit binary word may correspond to one of the zones on the path 102.

In some aspects of the disclosure, each of the location indicator devices 110, 112, 114, 116, 118, 120, 122 may include one or more magnetic trigger elements, such as a magnet or any magnetic material capable of triggering a corresponding magnetically controlled contact switch 650, 652, 654 (e.g., capable of changing a state of the magnetically controlled contact switch 650, 652, 654 from ON to OFF or from OFF to ON depending on the implementation). In some aspects of the disclosure, each of the magnetically controlled contact switches 650, 652, 654 may output a first binary value (e.g., a logic '1') when triggered or a second binary value (e.g., a logic '0') when not triggered. In some aspects of the disclosure, the binary outputs (e.g., logic '1' or logic '0') from the magnetically controlled contact switches 650, 652, 654 of the contact switch sensor 106 may be grouped together to produce a 3-bit binary word similar to the implementations previously explained with reference to FIGS. 2 and 3.

In one example implementation, the magnetically controlled contact switches 650, 652, 654 may output a logic '1' when triggered or a logic '0' when not triggered. In this implementation, the location indicator devices 110, 112, 114, 116, 118, 120, 122 in FIG. 6 may be configured to communicate the corresponding 3-bit binary words '001', '010', '011', '100', '101', '110', '111' to the contact switch sensor 106 when the contact switch sensor 106 is situated proximate (e.g., at a distance of 10 centimeters (cm) or less) to a location indicator device. For example, with reference to the first location indicator device 110 in configuration 632, the first location indicator device 110 may trigger the magnetically controlled contact switch 654 (e.g., via the magnetic trigger element 646) and may not trigger the magnetically controlled contact switches 650, 652 to communicate the 3-bit binary word '001' to the contact switch sensor 106 as the contact switch sensor 106 passes by the first location indicator device 110. As another example, with reference to the second location indicator device 112 in configuration 634, the magnetic trigger element 648 may trigger the magnetically controlled contact switch 652 to communicate the 3-bit binary word '010' to the contact switch sensor 106 as the contact switch sensor 106 passes by the second location indicator device 112. In the example implementation of FIG. 6, the 3-bit binary words '001', '010', '011', '100', '101', '110', '111' may respectively correspond to zones 1 through 7 of the path 102 in FIG. 1.

Figure 7:
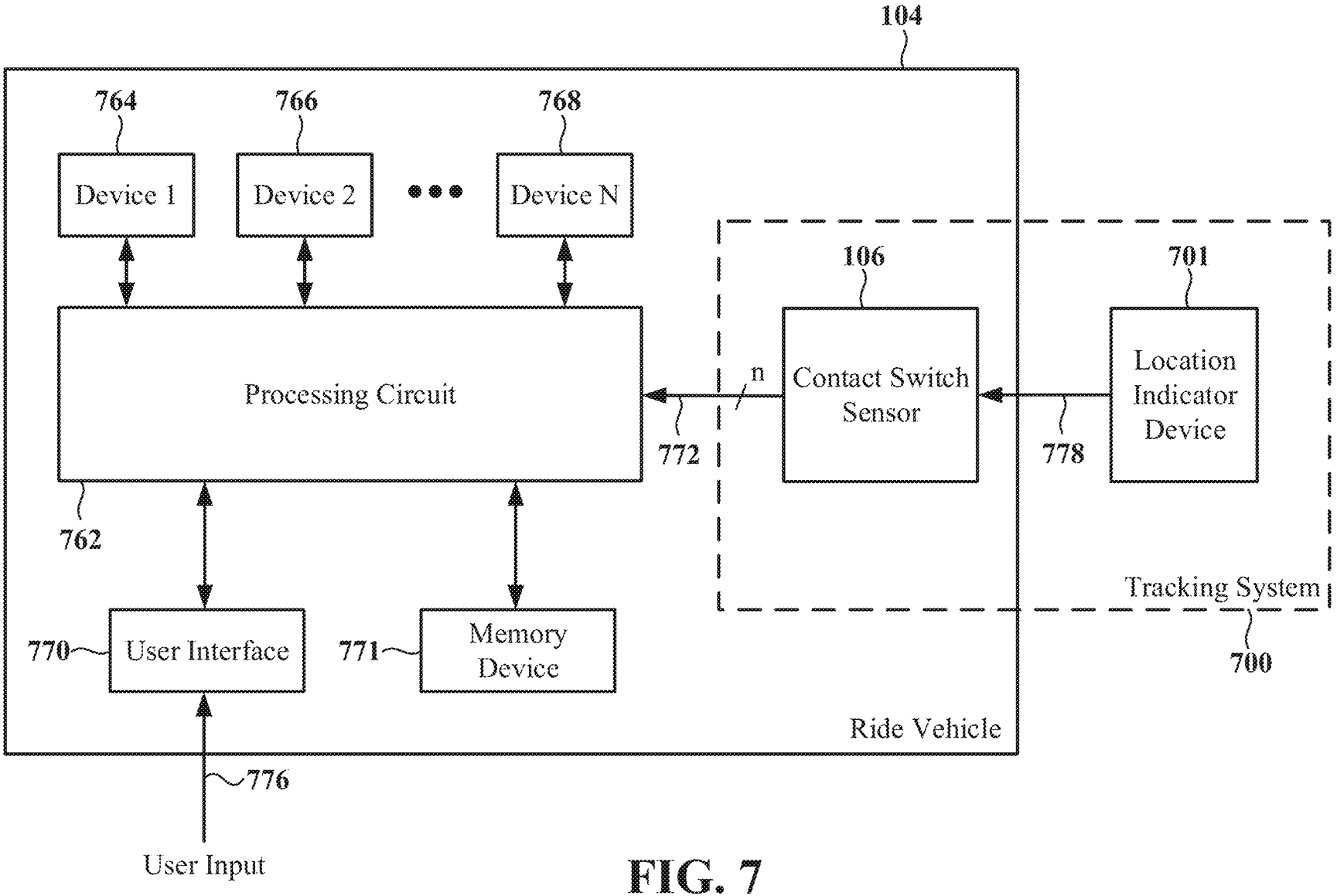
FIG. 7 illustrates a block diagram of a ride vehicle and a tracking system in accordance with various aspects of the disclosure.

FIG. 7 illustrates a block diagram of the ride vehicle 104 and a tracking system 700 in accordance with various aspects of the disclosure. In some aspects of the disclosure, and as shown in FIG. 7, the ride vehicle 104 may include a processing circuit 762, a first on-board device 764, a second on-board device 766, an Nth on-board device 768, a user interface 770, a memory device 771, and the contact switch sensor 106. In some examples, the processing circuit 762 may be a subsystem controller (SSC). The on-board devices 764, 766, 768 may be devices installed in or on the ride vehicle 104.

In some aspects of the disclosure, one or more of the on-board devices 764, 766, 768 may serve to entertain and/or enhance the user experience while riding the ride vehicle 104. For example, the first on-board device 764 may include a digital monitor capable of displaying menus, controls, videos, still images, and/or interactive games, the second on-board device 766 may include an audio device, such as a sound speaker, and the Nth on-board device 768 may include one or more lighting devices configured to illuminate the inside and/or outside of the ride vehicle 104. The user interface 770 may include a touchscreen, a touchpad, a keyboard, a joystick, a tactile button, a knob, a lever, and/or any other suitable interface device(s). In some aspects of the disclosure, the processing circuit 762 may control and/or operate the on-board devices 764, 766, 768, the user interface 770, the memory device 771, and/or the contact switch sensor 106 based on software stored in a memory (e.g., the memory device 771).

As shown in FIG. 7, the tracking system 700 may include the contact switch sensor 106 and the location indicator device 701. In some aspects of the disclosure, the contact switch sensor 106 may receive location information 778 from the location indicator device 701. In some examples, the location indicator device 701 may be any one of the previously described location indicator devices 110, 112, 114, 116, 118, 120, and 122. Accordingly, the location information 778 may be communicated to the contact switch sensor 106 via one or more of the mechanisms described herein, such as by actuating switch levers via physical contact or by triggering magnetically controlled contact switches. The contact switch sensor 106 may provide the location information 778 to the processing circuit 762 in the form of a unique n-bit binary word 772. The value of n may correspond to the number of switches implemented at the sensor 106. For example, if the sensor 106 is implemented according to the aspects described with reference to FIG. 2, the sensor 106 may provide a unique 3-bit binary word to the processing circuit 762.

The processing circuit 762 may be configured to receive the n-bit binary word 772 and to search a table (e.g., Table 1) in the memory device 771 including a list of the possible n-bit binary words that may be received from the location indicator devices in the ride system 100. Upon finding a match for the n-bit binary word 772 in the table, the processing circuit 762 may determine the location of the ride vehicle 104 on the path 102 by obtaining (e.g., from the table) the location (e.g., zone) associated with the matched n-bit binary word 772. For example, with reference to Table 1, if the n-bit binary word 772 is '110', the processing circuit 762 may find the binary word '110' in Table 1 and may determine that the ride vehicle 104 is in zone 6 on the path 102.

The processing circuit 762 may be configured to customize the operation of the on-board devices 764, 766, 768 based on the location of the ride vehicle 104 on the path 102 previously described with reference to FIG. 1. For example, when the ride vehicle 104 is in the first portion 130 (e.g., zone 1) of the path 102, the processing circuit 762 may operate the on-board devices 764, 766, 768 and the user interface 770 according to a first configuration (e.g., ride vehicle configuration "A" in Table 1). When the ride vehicle 104 is in the second portion 132 (e.g., zone 2) of the path 102, the processing circuit 762 may operate the on-board devices 764, 766, 768 and the user interface 770 according to a second configuration (e.g., ride vehicle configuration "B" in Table 1). For example, the first configuration may allow the processing circuit 762 to enable all of the on-board devices 764, 766, 768, while the second configuration may require the processing circuit 762 to disable one or more of the on-board devices 764, 766, 768. In another example, the first and second configurations may allow the processing circuit 762 to interpret any user input 776 differently based on the location of the ride vehicle 104. In one example scenario, if the user interface 770 includes a tactile button, an actuation of the tactile button by a user when the ride vehicle 104 is in the first portion 130 (e.g., zone 1) of the path 102 may cause the processing circuit 762 to emit an audible sound effect (e.g., via a sound speaker in the second on-board device 766) in the ride vehicle 104. However, an actuation of the same tactile button when the ride vehicle 104 is in the second portion 132 (e.g., zone 2) of the path 102 may cause the processing circuit 762 to disable the audible sound effect and to illuminate (e.g., via a light source in the Nth on-board device 768) the interior and/or exterior of the ride vehicle 104.

Figure 8:
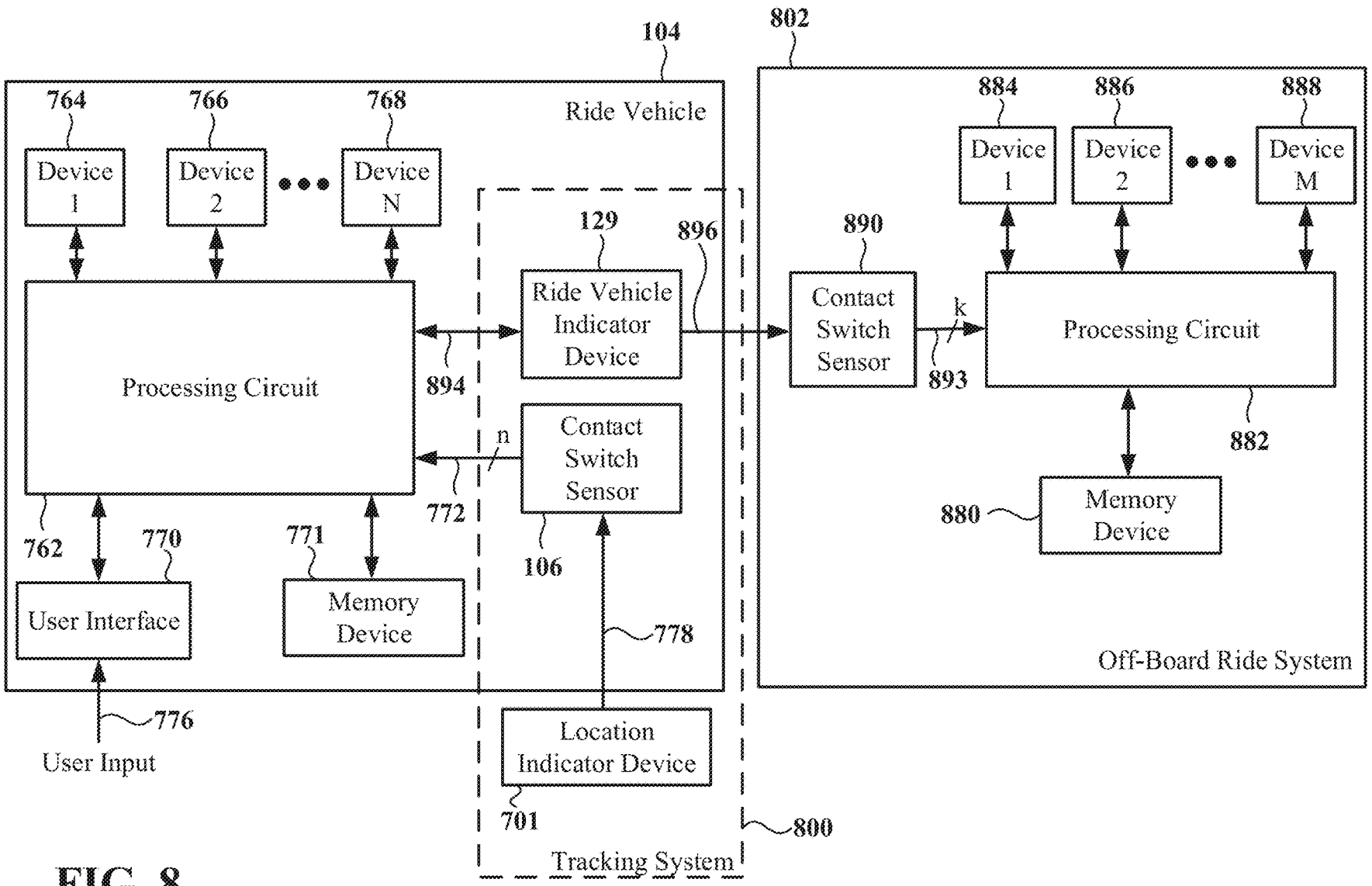
FIG. 8 illustrates a block diagram of a ride vehicle, a tracking system, and an off-board ride system in accordance with various aspects of the disclosure.

FIG. 8 illustrates a block diagram of a ride vehicle, a tracking system, and an off-board ride system in accordance with various aspects of the disclosure. As shown in FIG. 8, the ride vehicle 104 may include the processing circuit 762, the first on-board device 764, the second on-board device 766, the Nth on-board device 768, the user interface 770, the memory device 771, and the contact switch sensor 106 as previously described with reference to FIG. 7. The ride vehicle 104 may further include a ride vehicle indicator device 129 configured to communicate ride vehicle information 896 to an off-board ride system 802. In some aspects of the disclosure, and as shown in FIG. 8, the off-board ride system 802 may include a processing circuit 882, a first off-board device 884, a second off-board device 886, an Mth off-board device 888, a memory device 880, and a contact switch sensor 890.

As shown in FIG. 8, the tracking system 800 may include the contact switch sensor 106 of the ride vehicle 104, the ride vehicle indicator device 129, and the location indicator device 701. For example, the ride vehicle indicator device 129 may be implemented similar to any of the location indicator devices 110, 112, 114, 116, 118, 120, 122 described herein. In some aspects of the disclosure, the contact switch sensor 890 shown in FIG. 8 may be any one of the contact switch sensors 124, 126, 128 on the path 102 shown in FIG. 1. For example, the contact switch sensor 890 of the off-board ride system 802 may be implemented similar to the contact switch sensor 106 of the ride vehicle 104. Therefore, when the ride vehicle 104 passes by the contact switch sensor 890, the ride vehicle indicator device 129 may communicate ride vehicle information 896 to the contact switch sensor 890 in the form of a k-bit binary word via one or more of the mechanisms described herein, such as by actuating switch levers of the contact switch sensor 890 via physical contact or by triggering magnetically controlled contact switches of the contact switch sensor 890. The value of k may correspond to the number of switches implemented at the contact switch sensor 890.

In some examples, the k-bit binary word may be assigned exclusively to the ride vehicle 104, thereby allowing the off-board ride system 802 to specifically identify the ride vehicle 104 at various locations (e.g., zones) on the path 102. In these examples, other ride vehicles may be assigned different k-bit binary words. In other examples, same types of ride vehicles or ride vehicles of a same group may be assigned the same k-bit binary word. In the implementation shown in FIG. 1, the ride vehicle indicator device 129 may be installed underneath the ride vehicle 104. This may allow the ride vehicle indicator device 129 to communicate ride vehicle information to the contact switch sensor 890 installed on the path 102 when the ride vehicle 104 passes over the contact switch sensor 890.

The processing circuit 882 may be configured to receive the k-bit binary word 893 and to match the k-bit binary word 893 in a table that includes a list of unique k-bit binary words that may be received from a set of ride vehicles in the ride system 100. For example, the table may be stored in the memory device 880. Accordingly, the processing circuit 882 may use the k-bit binary word 893 and the table stored in the memory device 880 to immediately identify a particular ride vehicle at a location (e.g., zone) on the path 102. An example of the table that may be stored in the memory device 880 is shown in Table 2. In Table 2, each k-bit binary word is associated with a ride vehicle identifier (ID) and a zone configuration to be applied for the ride vehicle identifier.

TABLE 2

| k-bit binary word | Ride Vehicle ID | Zone Configuration |
|---|---|---|
| 001 | 1 | Q |
| 010 | 2 | R |
| 011 | 3 | S |
| 100 | 4 | T |
| 101 | 5 | U |
| 110 | 6 | V |
| 111 | 7 | W |

The off-board devices 884, 886, 888 may be devices installed in the ride system 100, but not on the ride vehicle 104. In some aspects of the disclosure, one or more of the off-board devices 884, 886, 888 may be located in a same zone of the path 102 and may serve to entertain and/or enhance the user experience while riding the ride vehicle 104. In other aspects of the disclosure, one or more of the off-board devices 884, 886, 888 may be located at different zones. For example, the first off-board device 884 may include a media projection device capable of displaying videos, still images, and/or interactive games, the second off-board device 886 may include an audio device, such as a sound speaker, and the Mth off-board device 888 may include one or more animatronic devices. In some aspects of the disclosure, the processing circuit 882 may control and/or operate the off-board devices 884, 886, 888, memory device 880, and/or the contact switch sensor 890 based on software stored in a memory (e.g., the memory device 880).

In one example implementation, the off-board devices 884, 886, 888 may be installed in zone 2 (e.g., the second portion 132) of the path 102. The processing circuit 882 may be configured to customize the operation of the off-board devices 884, 886, 888 based on the specific ride vehicle (e.g., ride vehicle 104) present in zone 2 of the off-board devices 884, 886, 888. For example, when the ride vehicle 104 is in zone 2, the processing circuit 882 may operate the off-board devices 884, 886, 888 according to a first off-board configuration. When a different ride vehicle is in zone 2 of the path 102, the processing circuit 882 may identify the different ride vehicle based on the ride vehicle information received from the different ride vehicle (e.g., via the contact switch sensor 890) and may operate the off-board devices 884, 886, 888 according to a second off-board configuration.

For example, the processing circuit 882 may determine the appropriate off-board configuration (also referred to as zone configuration) to be applied for each ride vehicle ID using the zone configuration column in Table 2. For example, the first off-board configuration (e.g., zone configuration "Q" in Table 2) may allow the processing circuit 882 to display a first video (e.g., via the media projection device in the first off-board device 884) in zone 2 for a first ride vehicle (e.g., ride vehicle ID 1 in Table 2), while the second configuration (e.g., zone configuration "R" in Table 2) may allow the processing circuit 882 to display a second video (e.g., via the media projection device in the off-board device 1 884) for a second ride vehicle (e.g., ride vehicle ID 2 in Table 2) in zone 2.

In some aspects of the disclosure, the ride vehicle indicator device 129 may be modified based on a command from the processing circuit 762. For example, the ride vehicle indicator device 129 may be implemented with one or more actuators that are configured to change the physical characteristics of the ride vehicle indicator device 129. In this example, the processing circuit 762 may transmit a command via the data path 894 that modifies the physical characteristics of the ride vehicle indicator device 129 so that the ride vehicle indicator device 129 communicates a different k-bit binary word to the contact switch sensor 890. This may enable the processing circuit 762 to efficiently change the identity of the ride vehicle 104 (e.g., the ride vehicle ID in Table 2) in accordance with the characteristics (e.g., a story, a theme, a fictional character, etc.) associated with the ride vehicle 104 during operation of the ride system 100.

In some aspects of the disclosure, a ride vehicle indicator device (e.g., the ride vehicle indicator device 129) and an on-board contact switch sensor (e.g., the contact switch sensor 890) may be integrated into a first sensor and indicator device, and a location indicator device (e.g., the location indicator device 701) and an off-board contact switch sensor (e.g., the contact switch sensor 890) may be integrated into a second sensor and indicator device. The first sensor and indicator device may be installed on the ride vehicle 104. In these aspects, when the ride vehicle 104 passes the second sensor and indicator device, the first sensor and indicator device may communicate unique ride vehicle information to the second sensor and indicator device, while also receiving location information from the second sensor and indicator device. In some examples, the first and second sensor and indicator devices may be implemented using switch levers that are configured to actuate one another.

Figure 9:
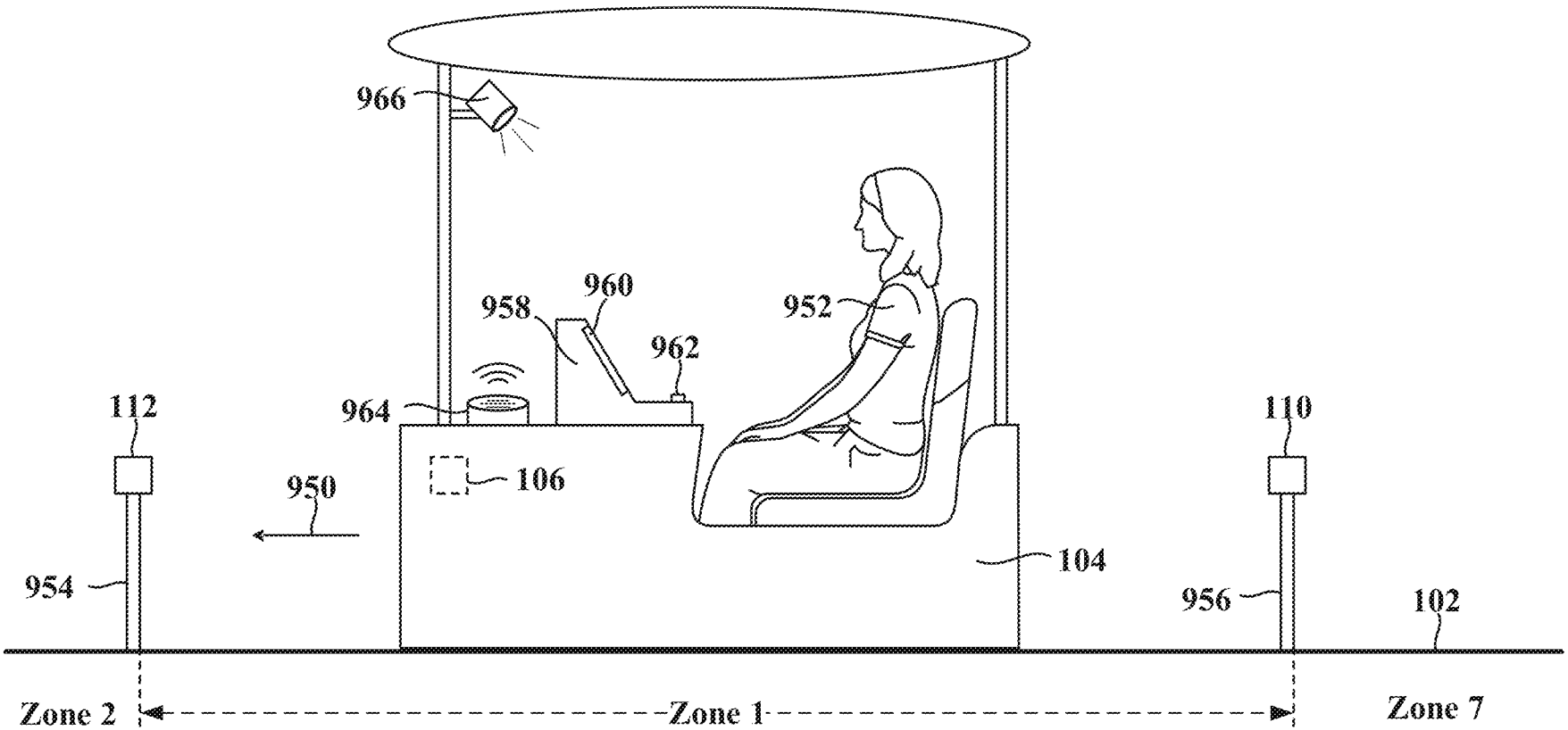
FIG. 9 illustrates a side view of a ride vehicle on a path of a ride system in accordance with various aspects of the disclosure.

FIG. 9 illustrates a side view of the ride vehicle 104 on the path 102 of the ride system 100 in accordance with various aspects of the disclosure. As shown in FIG. 9, the ride vehicle 104 may travel along the path 102 in a forward direction 950 while carrying at least one passenger 952 (also referred to as a user). As further shown in FIG. 9, the ride vehicle 104 may include the contact switch sensor 106 installed at a side of the ride vehicle 104 (e.g., to the right of the passenger 952). The position of the contact switch sensor 106 on the ride vehicle 104 may be aligned with the location indicator devices (e.g., location indicator devices 110, 112) in the ride system 100. As shown in FIG. 9, the location indicator devices (e.g., location indicator devices 110, 112) may be mounted on posts 954, 956. In other aspects of the disclosure, the location indicator devices (e.g., location indicator devices 110, 112) may be mounted to a wall (e.g., with brackets, adhesive, etc.), suspended from an elevated support (e.g., a truss, ceiling beam, etc.), and/or otherwise secured at an appropriate position to enable communication of location information to the contact switch sensor 106.

In some aspects of the disclosure, the ride vehicle 104 may include one or more on-board devices 958, 964, 966. In one example implementation, the on-board devices 958, 964, 966 in FIG. 9 may be the respective first, second, and Nth on-board devices 764, 766, 768 previously described with reference to FIG. 7. For example, the on-board device 958 may be a digital monitor including a display screen 960 capable of displaying menus, controls, videos, still images, and/or interactive games, the on-board device 964 may be an audio device, such as a sound speaker, and the on-board device 966 may be a light fixture configured to illuminate the inside and/or outside of the ride vehicle 104. The ride vehicle 104 may include a user interface 962. In one example implementation, the user interface 962 may be the user interface 770 previously described with reference to FIG. 7.

In some aspects of the disclosure, the contact switch sensors 106, 890 and the location indicator devices 110, 112, 114, 116, 118, 120, 122, 701 described herein may be constructed from robust materials, such as plastic, ceramic, metal, etc., to ensure longevity. Accordingly, the contact switch sensors 106, 890 and the location indicator devices 110, 112, 114, 116, 118, 120, 122, 701 described herein may be highly weather resistant and may allow for outdoor use in harsh weather conditions. Moreover, the contact switch sensors 106, 890 and the location indicator devices 110, 112, 114, 116, 118, 120, 122, 701 described herein may operate under any lighting conditions.

In some implementations, at least one portion of the path 102 of the ride system 100 may include a body of water (e.g., in scenarios where the ride vehicle 104 is implemented as a boat or a log for transporting passengers). In these implementations, the contact switch sensors and the location indicator devices described herein may be submerged in the body of water while retaining their full functions. In some aspects of the disclosure, if the body of water is moving with a certain flow rate and a contact switch sensor (e.g., the contact switch sensor 106) is implemented with switch levers (e.g., the switch lever 250, 252, 254 shown in FIG. 2), the switch levers may be configured to withstand the flow rate to prevent inadvertent or false actuations.

Since the ride vehicle 104 may determine its location (e.g., zone) along the path 102 by physically passing each of the location indicator devices, the ride vehicle 104 may not need to maintain a master clock for tracking purposes as it moves along the path 102. As a result, even if the ride vehicle 104 experiences a delay on the path 102, the location information from the location indicator devices (e.g., the location indicator devices 110, 112, 114, 116, 118, 120, 122) may be provided to the ride vehicle 104 on time and regardless of the speed of the ride vehicle 104. In addition, the described aspects may effectively reduce the complexity of a ride system (e.g., the ride system 100) because the contact switch sensors (e.g., the contact switch sensors 106, 890) may be configured to receive location information from the location indicator devices (e.g., the location indicator devices 110, 112, 114, 116, 118, 120, 122) via physical contact (e.g., actuation of switch levers) or via magnetic triggers. Thus, the ride system 100 described herein may not only avoid the need for costly networks and/or wireless communications to enable tracking in the ride vehicle 104, but may also reduce the processing workload and operational complexity of ride vehicles.

Figure 10:
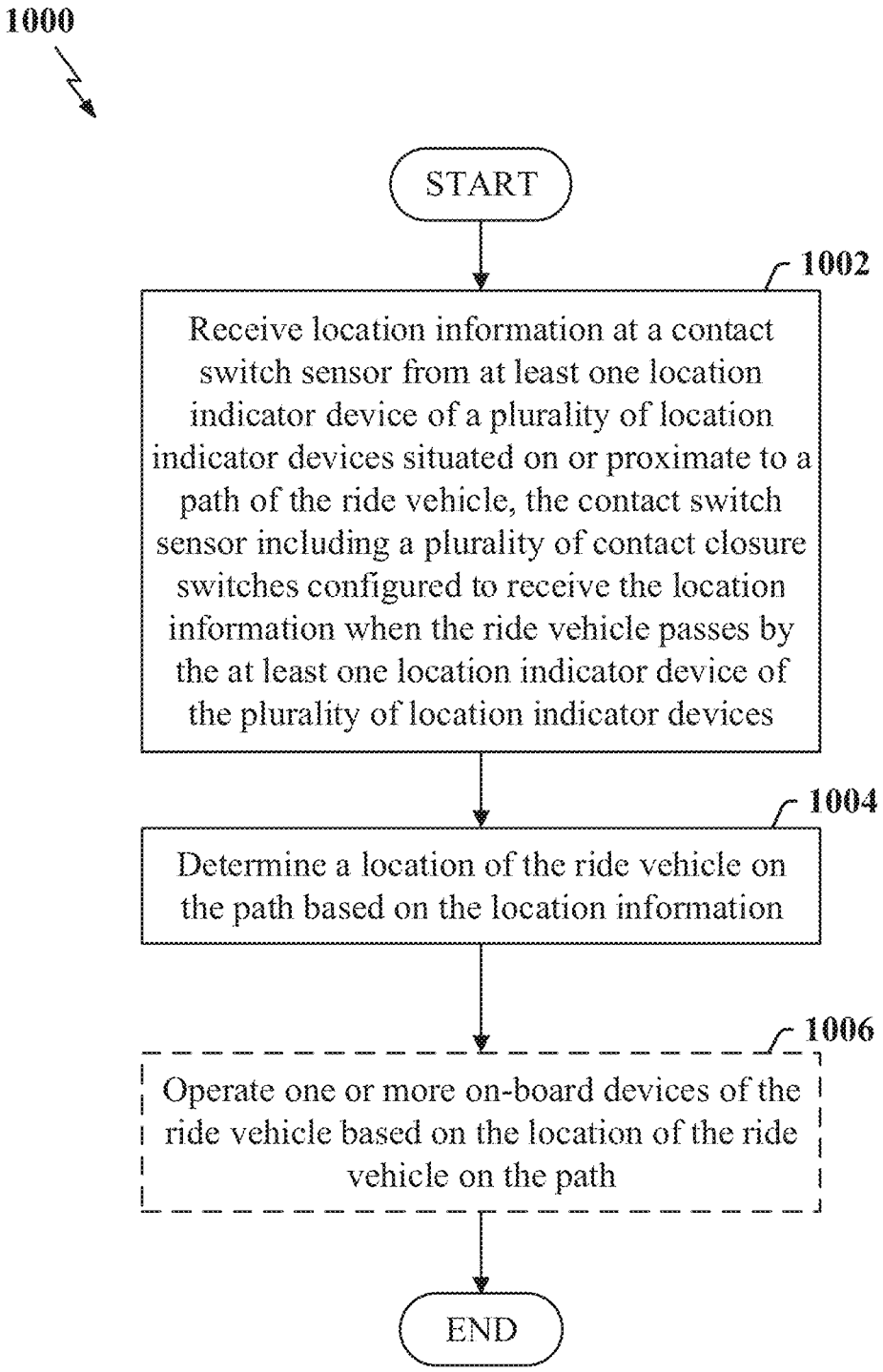
FIG. 10 is a flow chart in accordance with various aspects of the disclosure.

FIG. 10 is a flow chart illustrating an exemplary process 1000 for tracking a ride according to an aspect of the present disclosure. As described below, some or all illustrated features may be omitted in a particular implementation within the scope of the present disclosure, and some illustrated features may not be required for implementation of all embodiments. In some examples, the process 1000 may be carried out by a ride vehicle illustrated in FIGS. 1, 2, 4, and 7-9. In some examples, the process 1000 may be carried out by any suitable apparatus or means for carrying out the functions or algorithm described below. In FIG. 10, optional blocks are indicated with dashed lines.

At block 1002, the ride vehicle (e.g., the ride vehicle 104) receives location information (e.g., the location information 778) at a contact switch sensor (e.g., the contact switch sensor 106) from at least one location indicator device of a plurality of location indicator devices (e.g., the location indicator devices 110, 112, 114, 116, 118, 120, 701) situated on or proximate to a path (e.g., the path 102) of the ride vehicle. The contact switch sensor includes a plurality of contact closure switches (e.g., contact switches 462, 464, 466) configured to receive the location information when the ride vehicle passes by the at least one location indicator device of the plurality of location indicator devices. In some examples, the plurality of location indicator devices correspond to different zones (e.g., the zones 1 through 7 in FIG. 1) of the path of the ride vehicle, and the contact switch sensor is configured to output (e.g., via the plurality of contact closure switches) an n-bit binary word based on the location information. The n-bit binary word corresponds to one of the different zones. As described in detail herein, the location information may be communicated to the contact switch sensor from a location indicator device with a unique combination of actuations and non-actuations applied to the contact switch sensor with physical contact, or a unique combination of magnetic triggers and non-triggers applied the contact switch sensor without any physical contact.

In some aspects, the contact switch sensor further includes a plurality of switch levers (e.g., the switch levers 250, 252, 254, 450, 452, 454) configured to physically contact at least some of the plurality of location indicator devices. Each switch lever of the plurality of switch levers is configured to open or close a corresponding contact closure switch of the plurality of contact closure switches. In some examples, the plurality of contact closure switches are magnetically controlled contact switches (e.g., the magnetically controlled contact switches 650, 652, 654). In these examples, each location indicator device of the plurality of location indicator devices includes one or more magnetic trigger elements (e.g., magnetic trigger elements 646, 648).

At block 1004, the ride vehicle determines a location (e.g., one of zones 1 through 7 in FIG. 1) of the ride vehicle on the path based on the location information. In some examples, the location information may be represented as an n-bit binary word and the ride vehicle may use a table (e.g., Table) to determine a location (e.g., a zone) corresponding to the n-bit binary word.

At block 1006, the ride vehicle optionally operates one or more on-board devices (e.g., on-board devices 764, 766, 768) of the ride vehicle based on the location of the ride vehicle on the path. For example, when the ride vehicle 104 is in the first portion 130 (e.g., zone 1) of the path 102, the ride vehicle may operate the on-board devices 764, 766, 768 according to a first configuration (e.g., ride vehicle configuration "A" in Table 1). When the ride vehicle 104 is in the second portion 132 (e.g., zone 2) of the path 102, the ride vehicle may operate the on-board devices 764, 766, 768 according to a second configuration (e.g., ride vehicle configuration "B" in Table 1).

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other. For instance, a first object may be coupled to a second object even though the first object is never directly physically in contact with the second object.

One or more of the components, steps, features and/or functions illustrated in FIGS. 1-10 may be rearranged and/or combined into a single component, step, feature or function or embodied in several components, steps, or functions. Additional elements, components, steps, and/or functions may also be added without departing from novel features disclosed herein. The apparatus, devices, and/or components illustrated in FIGS. 1-10 may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. A tracking system for a ride vehicle, the tracking system comprising:

a contact switch sensor including a plurality of contact closure switches, the contact switch sensor being situated on the ride vehicle; and a plurality of location indicator devices situated on or proximate to a path of the ride vehicle, each location indicator device of the plurality of location indicator devices configured to communicate location information to the contact switch sensor via the plurality of contact closure switches when the ride vehicle passes by each location indicator device of the plurality of location indicator devices, wherein the contact switch sensor further includes a plurality of switch levers configured to physically contact at least one location indicator device of the plurality of location indicator devices, each switch lever of the plurality of switch levers configured to open or close a corresponding contact closure switch of the plurality of contact closure switches.

2. The tracking system of claim 1, wherein the plurality of contact closure switches are magnetically controlled contact switches, and wherein each location indicator device of the plurality of location indicator devices includes one or more magnetic trigger elements.

3. The tracking system of claim 1, wherein each location indicator device of the plurality of location indicator devices corresponds to a respective zone of a plurality of zones of the path of the ride vehicle.

4. The tracking system of claim 3, wherein the location information is communicated to the contact switch sensor with:

a unique combination of actuations and non-actuations applied with a physical contact, or a unique combination of magnetic triggers and non-triggers applied without the physical contact.

5. The tracking system of claim 4, wherein the contact switch sensor is configured to output a unique n-bit binary word based on the unique combination of actuations and non-actuations or the unique combination of magnetic triggers and non-triggers, and wherein the unique n-bit binary word corresponds to one of the respective zones of the plurality of zones.

6. The tracking system of claim 1, further comprising a ride vehicle indicator device situated on the ride vehicle and configured to communicate ride vehicle information to a contact switch sensor of an off-board ride system.

7. The tracking system of claim 6, wherein the contact switch sensor of the off-board ride system is situated on or proximate to the path of the ride vehicle, and wherein the ride vehicle information is a k-bit binary word that corresponds to the ride vehicle.

8. A ride vehicle, comprising:

a contact switch sensor including a plurality of contact closure switches, the contact switch sensor configured to receive location information from a plurality of location indicator devices via the plurality of contact closure switches; and a processing circuit configured to determine a location of the ride vehicle on a path based on the location information, wherein the contact switch sensor includes a plurality of switch levers configured to physically contact at least one location indicator device of the plurality of location indicator devices, each switch lever of the plurality of switch levers configured to open or close a corresponding contact closure switch of the plurality of contact closure switches.

9. The ride vehicle of claim 8, wherein the plurality of contact closure switches are magnetically controlled switches, and wherein each location indicator device of the plurality of location indicator devices includes one or more magnetic trigger elements.

10. The ride vehicle of claim 8, wherein each location indicator device of the plurality of location indicator devices corresponds to a respective zone of a plurality of zones of a path of the ride vehicle, and wherein the contact switch sensor is configured to output an n-bit binary word based on the location information, wherein the n-bit binary word corresponds to one of the respective zones of the plurality of zones.

11. The ride vehicle of claim 10, wherein the n-bit binary word includes binary outputs from the plurality of contact closure switches.

12. The ride vehicle of claim 8, further comprising a ride vehicle indicator device situated on the ride vehicle and configured to communicate ride vehicle information to a contact switch sensor of an off-board ride system.

13. The ride vehicle of claim 12, wherein the contact switch sensor of the off-board ride system is situated on or proximate to the path of the ride vehicle, and wherein the ride vehicle information is a k-bit binary word that corresponds to the ride vehicle.

14. A method for tracking a ride vehicle, the method comprising:

receiving location information at a contact switch sensor from at least one location indicator device of a plurality of location indicator devices situated on or proximate to a path of the ride vehicle, the contact switch sensor including a plurality of contact closure switches configured to receive the location information when the ride vehicle passes by the at least one location indicator device of the plurality of location indicator devices; and determining a location of the ride vehicle on the path based on the location information, wherein the contact switch sensor further includes a plurality of switch levers configured to physically contact at least one location indicator device of the plurality of location indicator devices, each switch lever of the plurality of switch levers configured to open or close a corresponding contact closure switch of the plurality of contact closure switches.

15. The method of claim 14, wherein the plurality of contact closure switches are magnetically controlled contact switches, and wherein each location indicator device of the plurality of location indicator devices includes one or more magnetic trigger elements.

16. The method of claim 14, wherein each location indicator device of the plurality of location indicator devices corresponds to a respective zone of a plurality of zones of the path of the ride vehicle, and wherein the contact switch sensor is configured to output an n-bit binary word based on the location information, wherein the n-bit binary word corresponds to one of the respective zones of the plurality of zones.

17. The method of claim 14, further comprising:

operating one or more on-board devices of the ride vehicle based on the location of the ride vehicle on the path.

* * * * *